US006170221B1

(12) United States Patent
Behunin

(10) Patent No.: US 6,170,221 B1
(45) Date of Patent: Jan. 9, 2001

(54) BLOCK AND BRICK WALL CONSTRUCTION SYSTEM

(76) Inventor: Gage Behunin, 1901 Leroy Dr. #B, Northglenn, CO (US) 80233

( * ) Notice: Under 35 U.S.C. 154(b), the term of this patent shall be extended for 0 days.

(21) Appl. No.: 09/227,100

(22) Filed: Jan. 7, 1999

Related U.S. Application Data

(63) Continuation-in-part of application No. 09/032,447, filed on Feb. 27, 1998, now Pat. No. 5,937,610.

(51) Int. Cl.[7] ..... E04G 21/04; E04G 11/08

(52) U.S. Cl. ..... 52/745.1; 52/745.13; 52/747.12; 52/749.13; 52/DIG. 1; 401/193

(58) Field of Search ..... 52/747.12, 749.13, 52/745.1, DIG. 1; 401/28, 48, 188 R, 193; 222/389, 611.2

(56) References Cited

U.S. PATENT DOCUMENTS

| | | | | |
|---|---|---|---|---|
| 1,779,007 | * | 10/1930 | Makowski | 52/747.12 X |
| 3,162,886 | * | 12/1964 | Wise | 401/193 X |
| 3,786,966 | * | 1/1974 | Behunin et al. | 222/387 |
| 3,830,678 | * | 8/1974 | Behunin | 52/749.13 X |
| 5,681,125 | * | 10/1997 | Amaya | 401/193 X |
| 5,878,921 | * | 3/1999 | Chase et al. | 222/333 |
| 5,937,610 | * | 8/1999 | Behunin | 52/741.1 |

* cited by examiner

*Primary Examiner*—Christopher T. Kent
(74) *Attorney, Agent, or Firm*—Edwin H. Crabtree; Ramon L. Pizarro; Donald W. Margolis

(57) ABSTRACT

A system and method for delivering mortar to blocks or bricks used for forming a wall. The system includes a pressurized tank which is used for receiving and dispensing the mortar at an elevated pressure. A delivery hose is attached to the tank. The delivery hose serves for carrying the mortar from the pressurized tank to a desired location. A bifurcated nozzle having an inlet and a pair of outlets is used for concurrent delivery of the mortar. The nozzle is attached to the delivery hose. The inlet of the nozzle is in fluid communication with the delivery hose. The mortar is delivered from the pressurized tank through the hose and then discharged as a plurality of streams or beads of mortar from the outlets of the nozzle onto the block used for forming the wall. The streams of mortar are placed on the ends and opposite edges of the side face of the block. Each block is placed end to end next to each other forming a first course of blocks. Additional blocks are placed on top of the side of the first course of blocks forming a second course of block. The wall continues upwardly as blocks are positioned over streams of mortar placed on the sides of each course of blocks. The position of the streams of mortar on the blocks is controlled by an index guide that is mounted on the nozzle. The index guide is used to engage the side of an alignment panel.

16 Claims, 2 Drawing Sheets

BLOCK AND BRICK WALL CONSTRUCTION SYSTEM

This patent application is a continuation-in-part application of an application having Ser. No. 09/032,447 filed on Feb. 27, 1998 now U.S. Pat. No. 5,937,610 having a title of "METHOD OF FORMING A STRUCTURAL BLOCK AND BRICK WALL" by the subject inventor.

BACKGROUND OF THE INVENTION (a) Field of the Invention

This invention relates to a new system and method for building wall construction and more particularly, but not by way of limitation, to a system and method for placing mortar on structural block or brick in order to build a wall or the like from the block or brick.

(b) Discussion of Known Art

Heretofore, brick and block masonry walls have been built by hand, one brick or block at a time. The wall was erected using hand tools for applying mortar on the sides and on the tops of the bricks or blocks. The mortar was mixed on site. This type of wall construction is labor intensive, it is expensive, it is time consuming, it requires mixing mortar on site and it requires skilled masons for well constructed walls.

Also, brick and block walls have been preconstructed by forming walls in forms on a horizontal surface on a job site. When the wall is completed, the wall is hoisted upwardly using heavy equipment into a vertical position and attached to a side of a building. This method of wall construction is also time consuming and expensive when having to use additional equipment for lifting each completed wall into place.

The subject invention as described herein eliminates the above mentioned problems related to brick and block wall construction. The new method of wall construction allows unskilled brick layers to build a brick or block wall. The method takes half the time when compared to building brick and block walls using mortar and hand tools thereby greatly reducing the overall cost of building construction.

SUMMARY OF THE INVENTION

In view of the foregoing, it is a primary objective of the subject system and method of forming a structural wall to greatly reduce the time required to build either a brick or a block wall. The reduced time being in an order of up to half of what is normally required in standard brick and block wall construction using mortar and mason hand tools.

Another object of the invention is to eliminate the need for manual application of mortar, the mixing of mortar and eliminating mortar clean up after the wall is built. Additionally, because only a stream or bead of mortar is used, the holes in the brick or block are free for receiving steel reinforcing bars and the like for strengthening the wall construction. Thus, a wall built using the disclosed construction system and method is well suited for use in earth quake areas.

Still another object of the disclosed invention is to provide a system and method which allows the use of novice or unskilled workman to quickly build a brick or block wall that is straight, level and plumb thereby eliminating the need for skilled craftsman. The wall can be build at a greatly reduced cost due to savings in time and labor.

Yet another object of the invention is the wall can be started at any part of the building i.e. a corner, a center, etc. Further, a minimum of scaffolding is required using the disclosed type of wall construction system and method.

An important feature of the disclosed invention is the use of a mortar delivery system which uses compressed air to force mixed mortar through a hose to a delivery nozzle. The nozzle eliminates the need to use a trowel and mortar holding bin during the erection of block buildings.

Another important new and useful result achievable with the instant invention is the precise and expedient delivery of the optimal amounts of mortar needed for the proper construction of a block or brick wall.

A further object of the invention is the new wall construction system and method uses light weight alignment panels or alignment grids which are used as a guide during the brick or block laying. The panels provide a means for keeping the new wall plumb, straight and level. The panels eliminate the need for having to continuously use a hand level or plumb line to double check if the wall is level or plumb as the bricks or blocks are laid course after course. The panels also serve as a guide for the nozzle used with the invention to assure proper placement of the precise amounts of mortar to be used. Also, window and door frames can be attached to the side of an alignment panel for ease in installation.

The new method of forming a structural wall using either lightweight or heavyweight block or brick and using lightweight removable alignment panels includes first installing one or more removable panels vertically next to a chalk line on a building foundation. The chalk line is used to mark a horizontal line along one side of the wall to be constructed. Each panel is plumbed vertically and leveled horizontally. The panel includes horizontal level lines 8 inches, 2 feet and 6 feet from a bottom of the panel. The level lines are used as a level guide to make sure each row or course of blocks are level as a block wall is built upwardly. This method as described herein will apply equally well to building a brick wall. Also, the bottom of the alignment panel is used as leveling device for the floor or foundation.

Mortar is now placed on the bottom and on one end of a plurality of concrete blocks for forming a first course of blocks. The blocks are then laid end to end next to each other and next to one side of the alignment panel for forming a first course of blocks. The mortar is now applied to the top of the first course of blocks. The mortar is now applied to the ends of a plurality of concrete blocks for forming a second course of blocks. The blocks are then laid end to end next to each other on top of the first course of blocks for forming a second course of blocks. The applying of the mortar to the blocks and laying a third course of blocks and additional courses of blocks one on top of each other is continued upwardly until the top of the last course of blocks coincides with the top of the alignment panel.

These and other objects of the present invention will become apparent to those familiar with brick and block wall construction and the problems associated therewith from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF PREFERRED EMBODIMENTS

While the invention will be described and disclosed in connection with certain preferred embodiments, the description is not intended to limit the invention to the specific embodiments shown and described, but rather the invention is intended to cover all alternative embodiments and modifications that fall within the spirit and scope of the invention as defined by the claims included herein as well as any equivalents of the disclosed and claimed invention.

Figure 1:
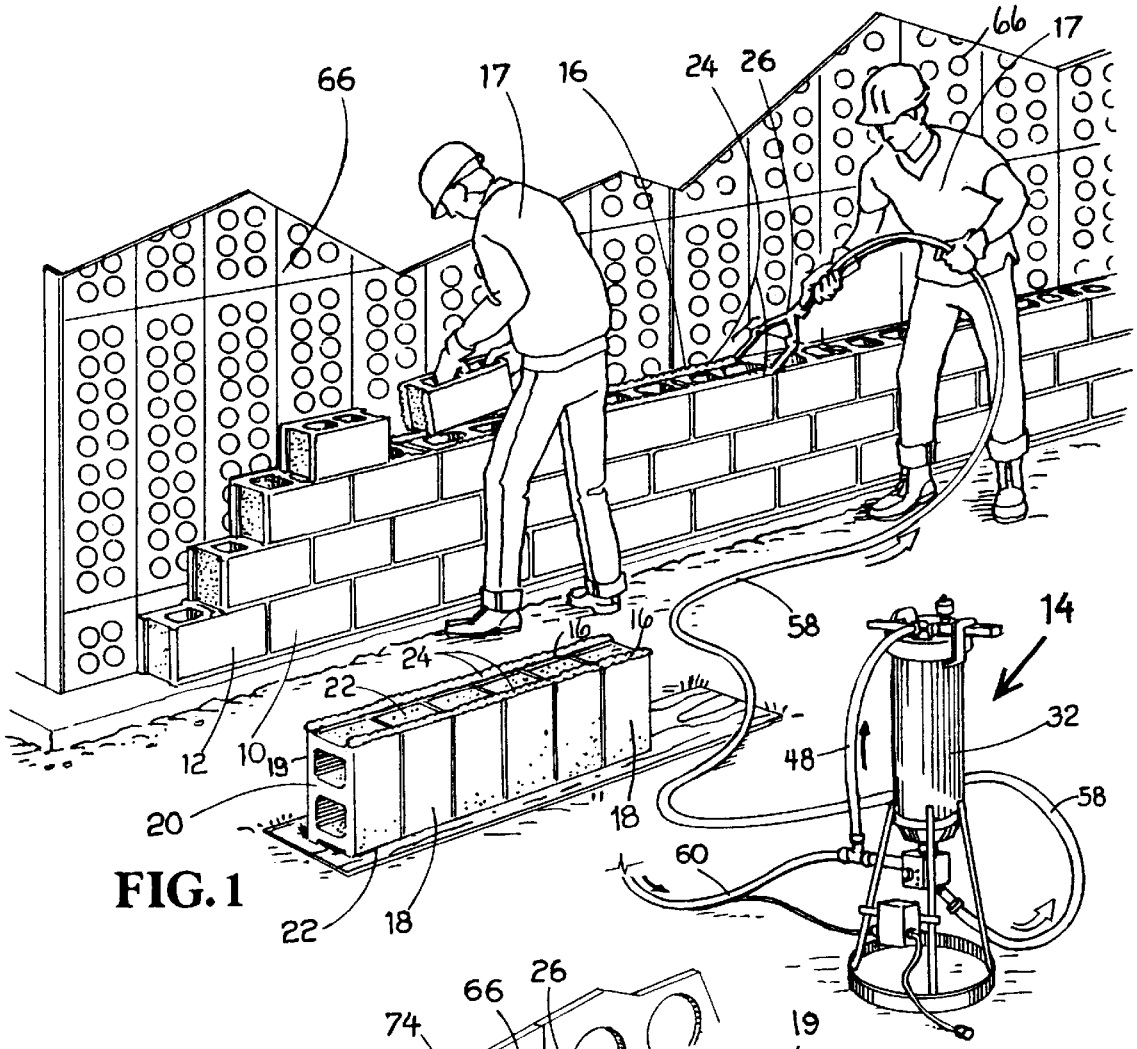
FIG. 1 is a perspective view of a pair of workmen using the disclosed system to forming a structural wall using either lightweight or heavy weight blocks by means of the disclosed method. The new wall is shown formed on a horizontal foundation using a pair of removable lightweight alignment panels as a guide to keep the wall plumb, straight and level during the laying of each row or course of blocks. In this drawing, one workman is shown applying a bonding agent, such as mortar, with the nozzle of the disclosed invention on top of a course of blocks. A second workman is shown setting a block on top of a course of blocks with the mortar thereon. The block is also placed next to a block already laid.

In FIG. 1, it will be understood that the system taught herein serves for building a wall 10 from a series of blocks 12. It is important to note that the term block as used includes bricks or other construction pieces or components that are stackable and useful for forming a wall or the like, whether structural or aesthetic.

The wall 10 shown in FIG. 1 is being erected with the aid of a system for delivering a construction adhesive, which in a preferred embodiment is a mortar composition 16, to the blocks 12 while forming the wall 10. The system in the drawings is shown having general reference numeral 14. The system 14 is shown being implemented by workmen 17. The blocks 12 are held together with the mortar composition 16 which, as stated above, is delivered by the system 14 on to the blocks 12. In practice, a pair of streams or beads of the mortar composition 16 will be continuously delivered to the blocks 12. While the mortar composition 16 is mentioned herein, it should be noted that various types of adhesives and the like can be used equally well.

In the illustrated application of the instant invention the wall 10 is being built from blocks 12 which include an outer face 18 and an inner face 19, sides 21 with opposite edges 20 and opposing ends 22. This arrangement is found in concrete blocks as well as in bricks or components used to build walls.

The subject system 14 concurrently delivers a pair of streams 24 of mortar 16 to the blocks 12. The streams 24 are formed and delivered by a bifurcated nozzle 26. The nozzle 26 is shown in greater detail in FIGS. 2 and 4, and includes an inlet 28 and a pair of outlets 30. The outlets 30 are spaced apart from one another so that the streams 24 are delivered approximately directly over the edges 20 of the side 21 and the ends 22 of the blocks 12. The nozzle 26 with inlet 28 and outlets 30 are shown in greater detail in FIGS. 2 and 4. It is important to note that the system 14 uses the bifurcated nozzle 26 to achieve important new and useful results in speed of assembly and consistency of the wall 10 by delivering the mortar composition 16 to the ends 22 and edges 20 as a pair of streams 24. However, it is contemplated that the instant invention may be configured and used to deliver mortar as a single stream where needed.

Figure 2:
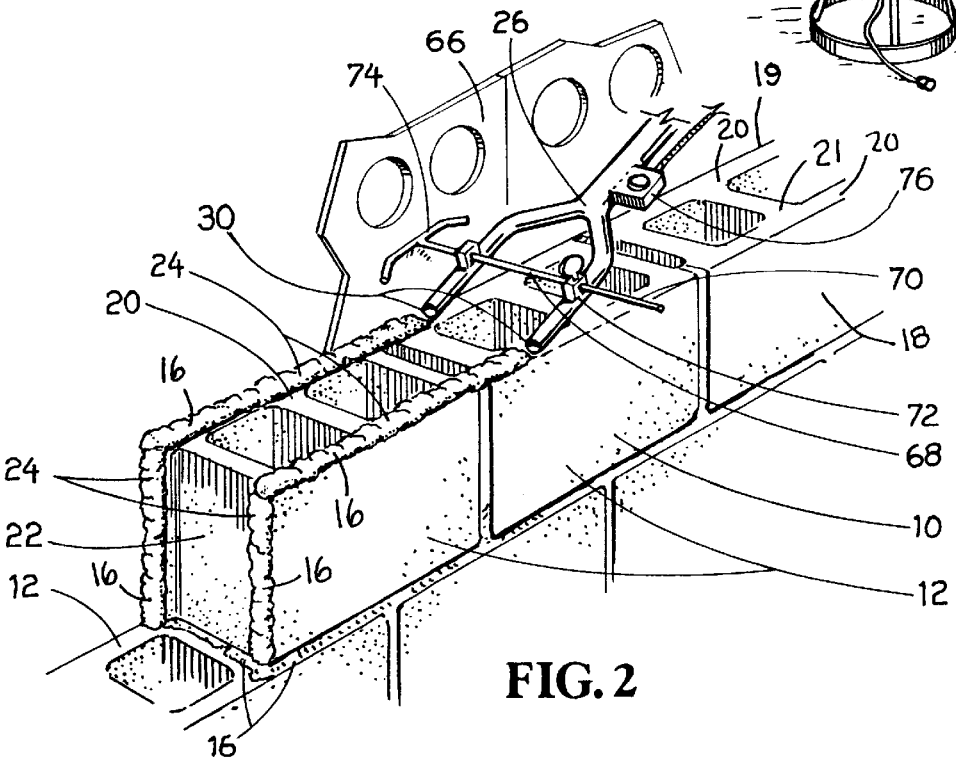
FIG. 2 is an enlarged perspective view of a course of blocks laid end to end. One of the blocks is shown with mortar spread along opposite edges of a side of the block and on one end of the block.

In FIG. 2, the nozzle 26 is shown as used to form the pair of streams 24 of mortar 16. The mortar 16 is delivered to the nozzle 26 from a tank 32 which holds the mortar 16 at an elevated pressure, illustrated in FIG. 3. It is important to note that it is contemplated that the function of the tank 32 may be carried out by an auger or other mechanisms which can deliver a viscous composition at an elevated pressure.

Figure 3:
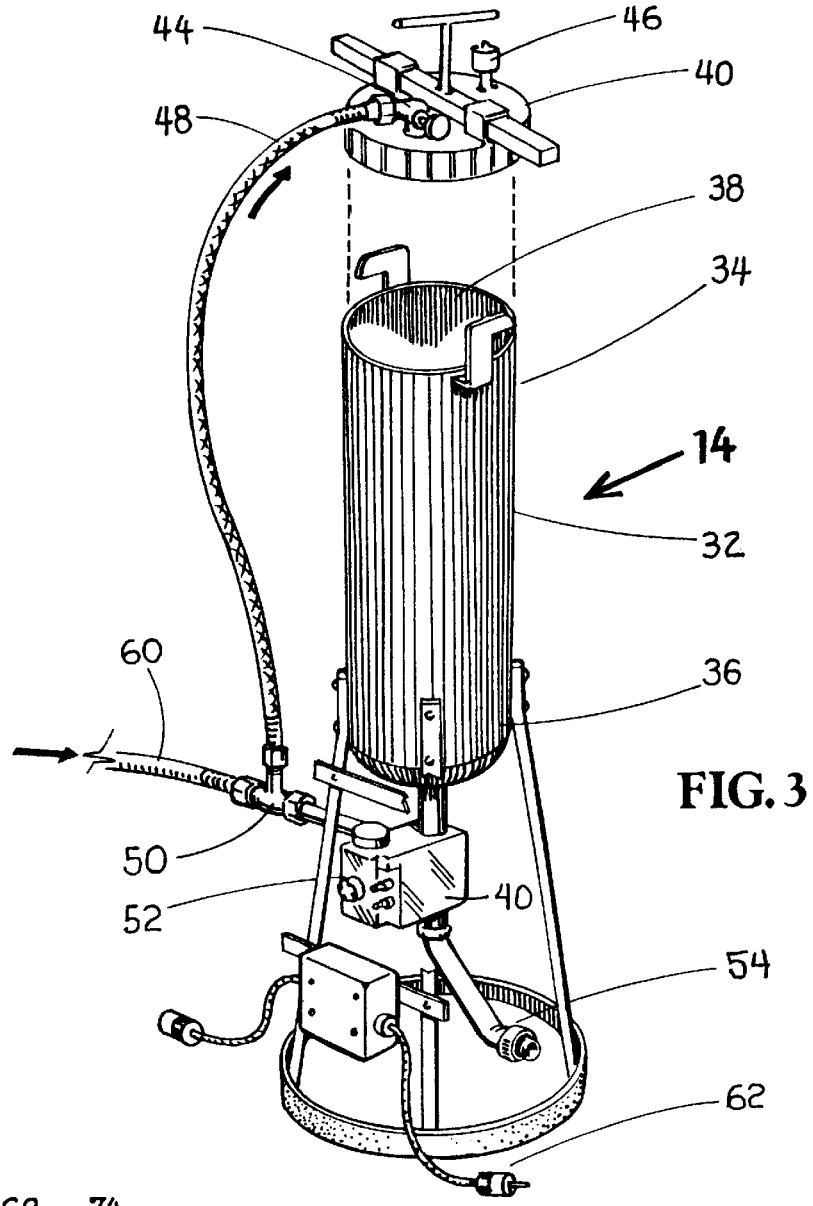
FIG. 3 is a perspective view illustrating the pressurized tank used with the disclosed invention. This view illustrates the tank with an access lid that allows for filling of the tank with mortar.

In FIG. 3, the tank 32 is shown having an upper portion 34 and a lower portion 36. The upper portion 34 includes an opening 38 for accepting the mortar 16. The lower portion 36 includes a control valve 40 for controlling the discharge of the mortar 16 from the tank 32. The tank 32 includes a lid 42 which serves to seal the opening 38 and maintain pressure in the tank 32. The lid 42 includes a pressure reducing valve and compressed air inlet 44 and a pressure relief value 46. The compressed air inlet 44 is attached to a air pressure hose 48 for pressurizing the tank 32 when the lid 42 has been secured over the opening 40. The tank 32 is pressurized in a range of 15 to 25 psi. The air pressure hose 48 is attached to an air inlet port 50.

The control valve 40 includes a remote control mechanism 52 which will allow the controlled delivery of mortar 16 from the bottom of the tank 32 through a discharge port 54 connected to one end 56 of a delivery hose 58. The remote control mechanism 52 is also connected to the air inlet port 50 and operates under air pressure in a range of 70 psi. The air inlet port 50 is connected to an air supply hose 60 which supplies pressurized air from an air compressor or similar air supply source. It has been discovered that by providing the remote control mechanism 52 to control the discharge or delivery of the mortar 16 from the tank 32, the workman 17 laying the blocks 12 can control the delivery of the mortar 16 at the point of application on the ends or edges of the blocks 12.

The mortar 16 is delivered from the tank 32 to the point of application by the delivery hose 58. Next to the hose 58 is a control wire 62 which serves for carrying a control signal to the remote control mechanism 52. The delivery hose 58 and the control wire 62 will preferably be of a sufficient length to extend from the tank 32 to the area where the wall 10 is being erected by the workman 17. Attached to an opposite end 64 of the delivery hose 58 is the inlet 28 of the bifurcated nozzle 26.

Figure 4:
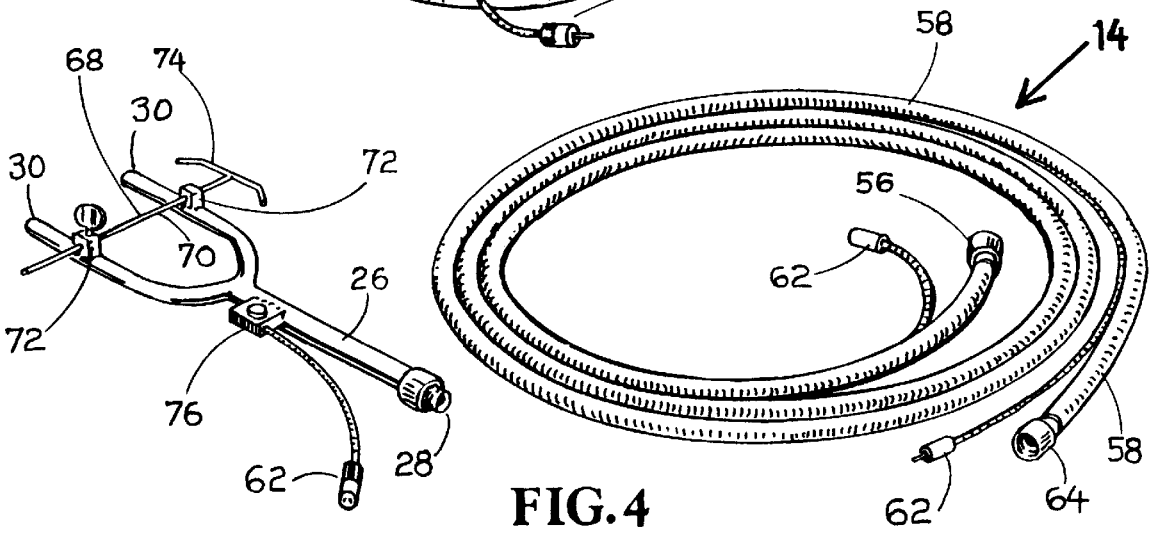
FIG. 4 is a perspective view of the bifurcated nozzle used with the instant invention. The view shows the hose and control wire that accompanies the hose. The hose attaches to the nozzle, while the wire connects to a switch mounted on the nozzle. The switch allows the user to control the delivery of the mortar from the tank into the hose.

In FIG. 4, the bifurcated nozzle 26 is shown having the inlet 28 and the pair of outlets 30. The inlet 28 is in fluid communication with the hose 36, so the mortar composition or similar adhesive, maybe delivered into the nozzle 26 from the tank 32 through the delivery hose 58. Once the mortar or adhesive enters the nozzle 26, the mortar will travel towards the outlets 30 of the nozzle 26. It is important to note that the nozzle 26 as shown is particularly useful for applying mortar to blocks 12 which include the pair of edges 20 which are spaced apart from one another. The outlets 30 of the nozzle 26 will preferably be spaced apart from one another at a distance that is approximately equal, or equal, to the distance at which the edges 20 are spaced apart from one another. This configuration will allow the user to deliver mortar directly on to the edges 20 of each side 21 of the block 12 as shown on FIG. 2. The ends 22 of the block 12 will also have surfaces that are spaced apart at approximately the same, or the same distance as the edges 20. Therefore, as shown on FIG. 2, it will be understood that the nozzle 26 will be particularly useful for simultaneously delivering the pair of streams 24 or beads of mortar directly on to the edges 20 of the side 21 of the blocks 12 and then to one of the ends 22 of the blocks 12. This delivery of the mortar on to the blocks 12 will allow expedient preparation of the individual blocks for stacking and erection of the wall 10.

Also shown on FIG. 1, it is contemplated that the system 14 will be used in conjunction with one or more alignment panels 66, which serves for guiding the positioning of the blocks 12 as the wall 10 is built. Thus, by first positioning the alignment panel 66 at a desired location relative to base or foundation over which the wall 10 is to be built, one may then use the panel 66 as a guide for building the wall 10. In FIG. 1, a pair of alignment panels 66 are shown joined together end to end. Also, the panels 66 can be joined together at right angles for forming walls at right angles to each other. The panels 66 can come in a variety of sizes and shapes and for example, the panels may be 3 feet, 6 feet and 12 feet in length and 4 feet and 8 feet in height and other sizes depending on the dimensions of the wall under construction. The disclosed nozzle 26 uses the numerous advantages of using the panel 66 by incorporating an index guide 68 which serves for indexing the position of the nozzle 26 relative to the panel 66 while placing a stream of mortar 16 on the blocks 12.

In FIG. 4, the index guide 68 includes an adjustment arm 70 which is slidably received through and tightened on a pair of posts 72. The posts 72 are mounted on the two outlets 30. The adjustment arm 70 allows the user to adjust the distance of the outlets 30 relative to the panel 66. The index guide 68 allows the workman 17 to guide the motion of the nozzle 26 relative to the panel 66. In order to achieve a smooth, uniform stream of mortar 16 at the desired locations along the ends 22 and edges 20 of the blocks 12, it is preferred that the nozzle 26 be guided to allow motion along a plane that is parallel to the panel 66. Towards this end, the nozzle 26 includes a panel arm 74 that is attached to and extends at right angles from the adjustment arm 70. The panel arm 74 is a straight edge that can slide against the side of the panel 66 to prevent the rotation of the nozzle 26 relative to the panel 66. Clearly, while the panel arm 74 has been shown as comprising a straight section of rod with rounded ends, it is contemplated that the function of the panel arm 74 may be accomplished by a set of rollers supported from the arm 70 and positioned along a plane or line, or even a set of wires and pulleys that prevent the variation of the position of the nozzle 26 relative to the alignment panel 66.

Also shown in FIG. 4 and mounted on or near the inlet 28 is a control switch 76 or other similar switching device which allows the workman 17 to actuate the remote control mechanism 52. This allows the workman to control the delivery of mortar 16 from the tank 32 into the delivery hose 58. It is important to note that while the disclosed preferred embodiment of the invention uses the control wire 62 to send a signal from the control switch 76 on to the remote control mechanism 52 , it is also contemplated that the control signal may be delivered by means of a mechanical connection, an air borne signal or other means for delivering a control signal from near the nozzle 26 to the control valve 40.

In operation, the erection of the wall 10 would be carried out over a foundation or floor. The lightweight removable wall panels 66 would be placed vertically next to a chalk line on the building foundation or floor. The chalk line is used to mark a horizontal line along one side of the wall to be constructed. The panel 66 is plumbed vertically and leveled horizontally. Once the panel has been positioned and the foundation or floor over which the wall is to be built has been leveled, the placement of a first course of blocks 12 is commenced by the workman 17. A pair of streams 24 of mortar 16 are placed on the ends 22 of each of the first course of blocks 12 with the blocks laid end to end. The placement of the blocks 12 is carried out along the chalk line by placing a steams 24 of mortar 24 on the block, foundation, or floor on which the wall is to be erected.

Once the course of blocks 12 has been positioned, a second course of blocks 12 may be placed over the first course of blocks. The placement of the second course of blocks 12 is carried by placing the streams 24 of mortar 16 over the edges 20 of the sides 21 of the first course of blocks 12, and then placing the corresponding blocks of the second course of blocks 12 over the first course. The position of the stream 24 over the first course of blocks is established by guiding the nozzle 26 over the edges 20 of the side 21 of the blocks 12 with the use of the index guide 68 and the panels 66. Thus, as the workman 17 guides the nozzle 26 with the aid of the index guide 68 and the panel 66, he will activate the delivery of mortar 16 through the nozzle 26 by activating the control switch 76.

It will be appreciated that the use of the disclosed invention will allow the precise placement of the desired amount of mortar 16 over the sides and ends of the blocks 12, and eliminate the need to have the workman 17 spread and mete out the needed amount of mortar with the use of a trowel. Thus the disclosed system and method eliminates the need to use workmen who are skilled in the placement and arrangement of mortar in the building of walls or the like.

Thus, it is important to note that while the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A method of forming a wall on a foundation from a first course of blocks and a second course of blocks attached to each other using mortar placed on ends of the blocks and on edges of a side of the blocks, the method using an alignment panel as a vertical guide, pressurized means for delivering the mortar to a nozzle, the nozzle having an outlet for receiving the mortar from the pressurized means, the nozzle having a pair of outlets for delivering the mortar to the blocks and a block index guide attached to the nozzle and engaging the alignment panel, the block index guide allowing the user to maintain the outlets of the nozzle at a desired distance from the alignment panel, the steps comprising:

delivering two deposits of mortar on the ends of the first course of blocks, the deposits of mortar being delivered from the pressurized means to the inlet of the nozzle and through the pair of outlets of the nozzle;

placing the first course of blocks on the foundation and next to the alignment panel and joining the blocks end to end to form a first course of blocks;

delivering two deposits of mortar on the edges of the sides of the first course of blocks;

delivering two deposits of mortar on the ends of the second course of blocks; and placing the second course of blocks on the sides of the first course of blocks and joining the blocks end to end to form a second course of blocks on top of the first course of blocks.

2. The method as described in claim 1 further including the step of placing mortar on the foundation prior to placing the first course of blocks on the foundation and next to the alignment panel and joining the blocks end to end to form a first course of blocks.

3. The method as described in claim 1 further including the step of placing a portion of the block index guide next to the alignment panel of guiding the nozzle in delivering the two deposits of mortar on the edges of the sides of the first course of blocks.

4. The method as described in claim 1 further including a step of delivering two deposits of mortar on the edges of the sides of the second course of blocks.

5. The method as described in claim 4 further including the step of placing a portion of the block index guide next to the alignment panel for guiding the nozzle in delivering the two deposits of mortar on the edges of the sides of the second course of blocks.

6. The method as described in claim 4 wherein the block index guide includes an adjustable arm mounted on the nozzle and a panel arm mounted on one end of the adjustable arm, the panel arm used for engaging the alignment panel when the nozzle is used for delivering the two deposits of mortar on the edges of the sides of the second course of blocks.

7. The method as described in claim 4 further including the steps of delivering two deposits of mortar on the ends of a third course of blocks and placing the third course of blocks on the sides of the second course of blocks and joining the blocks end to end to form a third course of blocks on top of the second course of blocks.

8. A system for delivering mortar to a plurality of blocks used for forming a wall, the system comprising:

panel means adapted for guiding the positioning of the blocks when forming a wall;

pressurized means adapted for dispensing the mortar at an elevated pressure;

a delivery hose adapted for carrying the mortar from said pressurized means to a desired location, said delivery hose being in fluid communication with said pressurized means;

a bifurcated nozzle having an inlet and a pair of outlets, the inlet being in fluid communication with said delivery hose;

an index guide mounted on said nozzle, a portion of said index guide received against said panel means when the mortar is dispensed, said index guide for indexing the position of said nozzle relative to said panel means for guiding the positioning of said nozzle on the blocks; and means for controlling a flow of mortar from said pressurized means to said delivery hose, said means for controlling a flow being actuateable from said nozzle so that a desired amount of the mortar delivered from said pressurized means through said delivery hose may be delivered from the outlets of said nozzle as a stream of mortar on to the blocks used for forming the wall.

9. A system according to claim 8 wherein said panel means is a plurality of removable wall panels.

10. A system according to claim 8 wherein said panel means is a fixed wall panel.

11. A system according to claim 8 wherein said pressurized means for delivering the mortar at an elevated pressure includes a tank having an upper end and a lower end, the upper end having an opening therein and adapted for receiving the mortar, and the lower end having valve means for controlling the delivery of the mortar from said tank.

12. A system according to claim 11 wherein said delivery hose for carrying the mortar from said tank to a desired location includes means for remotely controlling the delivery of the mortar from said valve means.

13. A system according to claim 11 further including an air supply hose connected to said tank for delivering pressurized air thereto.

14. A system for delivering mortar to a plurality of blocks used for forming a wall, the system comprising:

a plurality of removable wall panels adapted for guiding the positioning of the blocks when forming a wall;

a tank having an upper end and a lower end, the upper end having an opening therein and adapted for receiving the mortar, and the lower end having a valve means for controlling the delivery of the mortar from said tank.;

a delivery hose having one end connected to said tank, said hose adapted for carrying the mortar to a desired location;

a bifurcated nozzle having an inlet and a pair of outlets, the inlet connected to an opposite end of said delivery hose;

an index guide having a panel arm mounted on one end of an adjustment arm and at a right angle thereto, the adjustment arm adjustably mounted on said nozzle, the panel arm slidably received against said wall panels when the mortar is dispensed, said index guide for indexing the position of said nozzle relative to said wall panel for guiding the positioning of said nozzle on the blocks; and means for controlling a flow of mortar from said tank to said delivery hose, said means for controlling a flow being actuateable from said nozzle so that a desired amount of the mortar delivered from said tank through said delivery hose may be delivered from outlets of said nozzle as a stream of mortar on to the blocks used for forming the wall.

15. A system according to claim 14 wherein said delivery hose for carrying the mortar from said tank to a desired location includes means for remotely controlling the delivery of the mortar from said valve means.

16. A system according to claim 14 further including an air supply hose connected to said tank for delivering pressurized air thereto.

* * * * *